US010902776B2

(12) United States Patent
Zhou

(10) Patent No.: US 10,902,776 B2
(45) **Date of Patent: *Jan. 26, 2021**

(54) PIXEL CIRCUIT, DRIVING METHOD THEREOF AND DISPLAY DEVICE THEREOF

(71) Applicant: KunShan Go-Visionox Opto-Electronics Co., Ltd., Kunshan (CN)

(72) Inventor: Zhiyi Zhou, Kunshan (CN)

(73) Assignee: KunShan Go-Visionox Opto-Electronics Co., Ltd., Kunshan (CN)

( * ) Notice: Subject to any disclaimer, the term of this patent is extended or adjusted under 35 U.S.C. 154(b) by 26 days.

This patent is subject to a terminal disclaimer.

(21) Appl. No.: 16/434,751

(22) Filed: Jun. 7, 2019

(65) Prior Publication Data

US 2019/0287462 A1 Sep. 19, 2019

Related U.S. Application Data

(63) Continuation of application No. PCT/CN2018/092162, filed on Jun. 21, 2018.

(30) Foreign Application Priority Data

Oct. 31, 2017 (CN) ..... 2017 2 1426889 U

(51) Int. Cl.
*G09G 3/3233* (2016.01)
*G09G 3/3258* (2016.01)
(Continued)

(52) U.S. Cl.
CPC ..... *G09G 3/3233* (2013.01); *G09G 3/30* (2013.01); *G09G 3/3208* (2013.01);
(Continued)

(58) Field of Classification Search
CPC ..... G09G 2300/0426; G09G 2300/043; G09G 2300/0439; G09G 2300/0809;
(Continued)

(56) References Cited

U.S. PATENT DOCUMENTS 10,629,120 B2 * 4/2020 Zhou ..... G09G 3/3258
2007/0262931 A1 11/2007 Peng
(Continued)

FOREIGN PATENT DOCUMENTS

CN 103854609 A 6/2014
CN 104103239 A 10/2014
(Continued)

OTHER PUBLICATIONS

International Search Report dated Sep. 26, 2018 in corresponding International application No. PCT/CN2018/092162; 4 pages.

*Primary Examiner* — Afroza Chowdhury
(74) *Attorney, Agent, or Firm* — Maier & Maier, PLLC

(57) ABSTRACT

The application discloses a pixel circuit and a driving method thereof, a display device. The pixel circuit includes a first through seventh thin film transistor, a light-emitting diode, a storage capacitor and a compensation module. A gate of the first thin film transistor is separately connected to a source of the third and fourth thin film transistor and one end of the storage capacitor, a drain of the fourth thin film transistor is connected to a reference voltage signal line; source of the first thin film transistor is separately connected to a drain of the second and fifth thin film transistor and a source of the seventh thin film transistor; a drain of the first thin film transistor is separately connected to a drain of the third thin film transistor and a source of the sixth thin film transistor.

10 Claims, 2 Drawing Sheets

(51) Int. Cl.

| | |
|---|---|
| ***G09G 3/3266*** | (2016.01) |
| ***G09G 3/3291*** | (2016.01) |
| ***G09G 3/3208*** | (2016.01) |
| ***G09G 3/3225*** | (2016.01) |
| ***G09G 3/30*** | (2006.01) |

(52) U.S. Cl.
CPC ..... *G09G 3/3225* (2013.01); *G09G 3/3258* (2013.01); *G09G 3/3266* (2013.01); *G09G 3/3291* (2013.01); *G09G 2300/043* (2013.01); *G09G 2300/0426* (2013.01); *G09G 2300/0439* (2013.01); *G09G 2300/0809* (2013.01)

(58) Field of Classification Search
CPC ... G09G 2300/0861; G09G 2310/0251; G09G 2310/0262; G09G 2320/0223; G09G 3/30; G09G 3/3208; G09G 3/3225; G09G 3/3233; G09G 3/3258; G09G 3/3266; G09G 3/3291
See application file for complete search history.

(56) References Cited

U.S. PATENT DOCUMENTS

| | | | | |
|---|---|---|---|---|
| 2010/0020059 | A1* | 1/2010 | Suh | G09G 3/3233 345/212 |
| 2017/0103701 | A1* | 4/2017 | Zhu | G09G 3/3233 |

FOREIGN PATENT DOCUMENTS

| | | | |
|---|---|---|---|
| CN | 105336292 | A | 2/2016 |
| CN | 207474028 | U | 6/2018 |

* cited by examiner

PIXEL CIRCUIT, DRIVING METHOD THEREOF AND DISPLAY DEVICE THEREOF

CROSS-REFERENCE TO RELATED APPLICATIONS

This application claims priority to Chinese Patent Application No. 201721426889.5, entitled "PIXEL CIRCUIT AND DISPLAY DEVICE" filed Oct. 31, 2017, the contents of which is expressly incorporated herein by reference in its entirety.

TECHNICAL FIELD

The disclosure relates to the field of display technology, and more particularly to a pixel circuit, a driving method thereof and a display device thereof.

BACKGROUND TECHNOLOGY

An organic light-emitting display device is a display device in which an organic light-emitting diode is used as a light-emitting component, and has characteristics of high contrast, thin thickness, wide viewing angle, fast response speed, low power consumption, etc., and is increasingly applied to various fields of display and illumination.

In the existing organic light-emitting display devices, a plurality of pixel circuits may be generally included. The plurality of pixel circuits are generally supplied with power supply voltages from the same power supply. The power supply voltage can determine a current flowing through the light-emitting diode in the pixel circuit.

However, in practical applications, when the power supply voltage is transmitted between the plurality of pixel circuits, an power supply voltage drop (IR drop) is inevitably generated, resulting in different actual power supply voltages acting on each pixel circuit, and further resulting in different currents flowing through each light-emitting diode and uneven display luminance of the display device.

SUMMARY

The main purpose of the disclosure is to provide a pixel circuit, a driving method thereof, and a display device, which aims at solving the problem of the uneven display luminance of the display device due to different currents flowing through light-emitting diodes caused by a power supply voltage drop.

In order to achieve the above purpose, the pixel circuit provided by the disclosure comprises a first thin film transistor, a second thin film transistor, a third thin film transistor, a fourth thin film transistor, a fifth thin film transistor, a sixth thin film transistor, a seventh thin film transistor, a light-emitting diode, a storage capacitor and a compensation module, a gate of the first thin film transistor is separately connected to a source of the third thin film transistor, a source of the fourth thin film transistor and one end of the storage capacitor, a drain of the fourth thin film transistor is connected to a reference voltage signal line, and the other end of the storage capacitor is separately connected to a drain of the seventh thin film transistor and an output terminal of the compensation module, a input terminal of the compensation module is connected to a compensation voltage signal; a source of the first thin film transistor is separately connected to a drain of the second thin film transistor, a drain of the fifth thin film transistor and a source of the seventh thin film transistor, and a source of the second thin film transistor is connected to the data voltage signal line, and a source of the fifth thin film transistor is connected to the first power supply; and a drain of the first thin film transistor is separately connected to a drain of the third thin film transistor and a source of the sixth thin film transistor, and a drain of the sixth thin film transistor is connected to an anode of the light-emitting diode, and a cathode of the light-emitting diode is connected to a second power supply.

Optionally, the compensation module provides a compensation voltage, and the compensation module controls the compensation voltage to apply the compensation voltage to the gate of the first thin film transistor via the storage capacitor, and compensates for the power supply voltage provided by the first power supply, to make the voltage flowing through the light-emitting diode independent of the first power supply.

Optionally, the compensation voltage is a positive voltage and the compensation voltage is greater than the power supply voltage provided by the first power supply.

Optionally, the compensation voltage is a negative voltage, and the compensation voltage and a reference voltage provided by the reference signal line are provided by the same power supply.

Optionally, the first power supply provides a power supply voltage for the first thin film transistor; a current flows into the second power supply when the light-emitting diode emits light.

Optionally, the data voltage signal line provides a data voltage; the reference voltage signal line provides a reference voltage, and the reference voltage is a negative voltage and initializes the gate of the first thin film transistor.

Optionally, a gate of the fourth thin film transistor is connected to a first scan line, and when a first scan signal provided by the first scan line controls the fourth thin film transistor to make the fourth thin film transistor in an on-state, the reference voltage initializes the gate of the first thin film transistor; a gate of the second thin film transistor and a gate of the third thin film transistor are connected to a second scan line, and when a second scan signal provided by the second scan line controls the second thin film transistor and the third thin film transistor to make the second thin film transistor and the third thin film transistor in the on-state, the compensation voltage compensates for the threshold voltage of the first thin film transistor; a gate of the fifth thin film transistor, a gate of the sixth thin film transistor, and a gate of the seventh thin film transistor are connected to a light-emitting control line, and when a light-emitting control signal provided by the light-emitting control line controls the fifth thin film transistor, the sixth thin film transistor, and the seventh thin film transistor to make the fifth thin film transistor, the sixth thin film transistor, and the seventh thin film transistor in the on-state, the current flows through the light-emitting diode.

Optionally, the compensation module comprises a compensation voltage signal line and an eighth thin film transistor, the compensation voltage signal line provides the compensation voltage; a source of the eighth thin film transistor is connected to the compensation voltage signal line, a drain of the eighth thin film transistor is separately connected to the drain of the seventh thin film transistor and the other end of the storage capacitor, and a gate of the eighth thin film transistor is connected to the second scan line.

Optionally, when the second scan signal controls the eighth thin film transistor to make the eighth thin film transistor in the on-state, the compensation voltage signal line is connected to the other end of the storage capacitor, and the compensation voltage signal line applies a voltage to the storage capacitor; when the light-emitting control signal controls the fifth thin film transistor and the seventh thin film transistor to make the fifth thin film transistor and the seventh thin film transistor in the on-state, the first power supply is connected to the other end of the storage capacitor, the first power supply applies a voltage to the other end of the storage capacitor, and under the action of the storage capacitor, the current flowing through the light-emitting diode is related to the compensation voltage and independent of the first power supply.

Optionally, the first thin film transistor is a drive thin film transistor and the first thin film transistor is a P-type thin film transistor; the second thin film transistor, the third thin film transistor, the fourth thin film transistor, the fifth thin film transistor, the sixth thin film transistor, the seventh thin film transistor and the eighth thin film transistor are independently N-type thin film transistors or P-type thin film transistors.

Optionally, at least one of the second thin film transistor, the third thin film transistor, the fourth thin film transistor, the fifth thin film transistor, the sixth thin film transistor, the seventh thin film transistor and the eighth thin film transistor can be replaced with two common-gate thin film transistors.

The application provides a pixel circuit driving method, and the driving method is used for driving the pixel circuit recorded above, including: in a first stage, controlling the fourth thin film transistor to change the fourth thin film transistor from an off-state to an on-state by the first scan signal, and initializing the gate of the first thin film transistor and the one end of the storage capacitor by the reference voltage, controlling the second thin film transistor and the third thin film transistor to make the second thin film transistor and the third thin film transistor in the off-state by the second scan signal, and controlling the fifth thin film transistor, the sixth thin film transistor and the seventh thin film transistor to make the fifth thin film transistor, the sixth thin film transistor and the seventh thin film transistor in the off-state by the light-emitting control signal; in a second stage, controlling the fourth thin film transistor to change the fourth thin film transistor from the on-state to the off-state by the first scan signal, controlling the second thin film transistor and the third thin film transistor to change the second thin film transistor and the third thin film transistor from the off-state to an on-state by the second scan signal, and compensating for the threshold voltage of the first thin film transistor, controlling the fifth thin film transistor, the sixth thin film transistor and the seventh thin film transistor to make the fifth thin film transistor, the sixth thin film transistor and the seventh thin film transistor in the off-state by the light-emitting control signals, and applying the compensation voltage to the other end of the storage capacitor by the compensation module; in a third stage, controlling the fourth thin film transistor to make the fourth thin film transistor in the off-state by the first scan signal, and controlling the second thin film transistor and the third thin film transistor to change the second thin film transistor and the third thin film transistor from the on-state to the off-state by the second scan signal, controlling the fifth thin film transistor, the sixth thin film transistor, and the seventh thin film transistor to change the fifth thin film transistor, the sixth thin film transistor, and the seventh thin film transistor from the off-state to the on-state by the light-emitting control signal, and emitting light by the light-emitting diode.

Optionally, in the third stage, the compensation voltage compensates for the first power supply, and the current flowing through the light-emitting diode is independent of the first power supply.

The application also provides a display device, including the pixel circuit recorded above.

The following beneficial effects can be achieved by at least one of the above technical solutions adopted by the embodiments of the application:

The pixel circuit provided by the embodiments of the application includes the compensation module which can compensate for a power supply voltage acting on the pixel circuit during a light-emitting stage, so that the current flowing through the light-emitting diode is independent of the power supply voltage, thereby avoiding the problem of the uneven display of the display device due to different currents flowing through the light-emitting diodes caused by a power supply voltage drop.

In addition, the pixel circuit provided by the embodiments of the application can also achieve compensation for the threshold voltage of a drive thin film transistor, thereby effectively avoiding the problem of the uneven display of the display device due to different threshold voltages of drive thin film transistors.

DETAILED DESCRIPTION OF EMBODIMENTS

Figure 1:
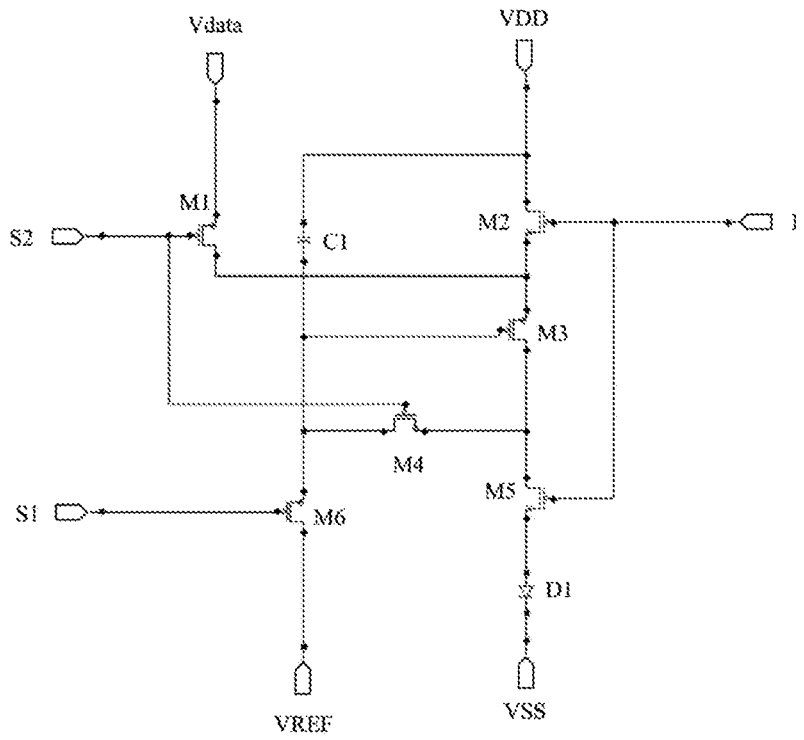
FIG. 1 is a schematic structural diagram of a pixel circuit in the prior art.

FIG. 1 is a schematic structural view of a pixel circuit included in the existing display device. As shown in FIG. 1, in a light-emitting stage of the pixel circuit, a current flowing through a light-emitting diode D1 is determined by a power supply voltage supplied by a power supply VDD, wherein the larger the power supply voltage supplied by the power supply VDD is, the larger the current flowing through the light-emitting diode D1 is, and the higher the luminance of the display device is.

However, when the power supply voltage supplied by the power supply VDD generates a power supply voltage drop, the actual power supply voltage acting on each pixel circuit in the display device is different, resulting in different currents flowing through the light-emitting diodes D1 and uneven display luminance of the display device.

In recent years, with the rapid development of display technology, the resolution of the display device gets higher and higher, and a high requirement for the high luminance of the display devices also gets higher and higher, so that the current in the display device is relatively large. With respect to the power supply voltage, since the power supply voltage serves to provide the driving current of the pixel circuit and the current flowing through the light-emitting diode, the current generated by the power supply voltage is relatively large, so that the power supply voltage drop generated during the transmission of the power supply voltage will be increased, resulting in a greater difference in the currents flowing through the light-emitting diodes in the pixel circuit shown in FIG. 1, and making the uneven display of the display device more evident.

As can be seen, it is necessary to provide a pixel circuit which can avoid the influence of the power supply voltage on the uneven display of the display device in the pixel circuit shown in FIG. 1.

In order to achieve the above object, an embodiment of the application provides a pixel circuit, a driving method thereof, and a display device thereof. The power supply voltage in the pixel circuit can be compensated by improving the circuit structure of the pixel circuit shown in FIG. 1 and adding a compensation module, so that the current flowing through the light-emitting diode is independent of the power supply voltage, thereby avoiding the problem of the uneven display of the display device due to different currents flowing through light-emitting diodes caused by the power supply voltage drop.

The technical solutions of the application are clearly and completely described below in conjunction with the specific embodiments of the application and the corresponding drawings. It should be noted that, in the pixel circuit provided by the embodiments of the application, a first thin film transistor is a drive thin film transistor, specifically, a P-type thin film transistor; a second thin film transistor, a third thin film transistor, a fourth thin film transistor, a fifth thin film transistor, a sixth thin film transistor, a seventh thin film transistor, an eighth thin film transistor may all be a P-type thin film transistor or a N-type thin film transistor, and at least one of a first thin film transistor is a drive thin film transistor, specifically, a P-type thin film transistor; a second thin film transistor, a third thin film transistor, a fourth thin film transistor, a fifth thin film transistor, a sixth thin film transistor, a seventh thin film transistor, an eighth thin film transistor may be a P-type thin film transistor and the remaining ones may be an N-type thin film transistor, which are not specifically limited in the embodiments of the application.

In the embodiment of the application, as for different types of thin film transistors, scan signals provided by different scan lines may be different. The embodiments of the application will be illustrated by taking the first thin film transistor to the eighth thin film transistor all being P-type thin film transistors for example.

The light-emitting diode may be an LED or an OLED, and is not specifically limited herein. The embodiments of the application will be illustrated by taking the light-emitting diode as the OLED for example.

Technical solutions provided by the embodiments of the application are described in detail below with reference to the accompanying drawings.

Figure 2:
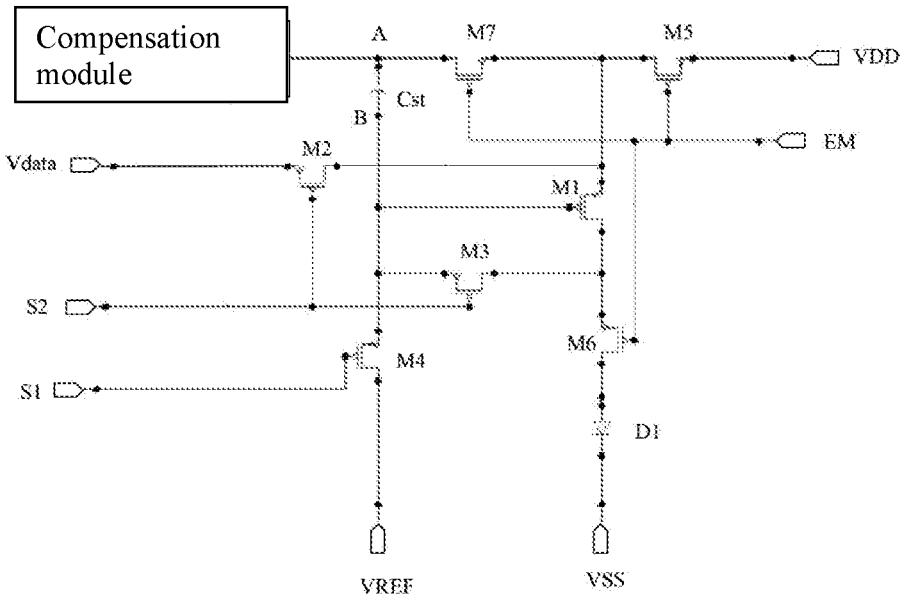
FIG. 2 is a schematic structural diagram of a pixel circuit provided by an embodiment of the application.

FIG. 2 is a schematic structural diagram of a pixel circuit provided by an embodiment of the application. The pixel circuit is as follows.

As shown in FIG. 2, the pixel circuit includes a first thin film transistor M1, a second thin film transistor M2, a third thin film transistor M3, a fourth thin film transistor M4, a fifth thin film transistor M5, a sixth thin film transistor M6, a seventh thin film transistor M7, a storage capacitor Cst, a light-emitting diode D1 and a compensation module.

In the pixel circuit shown in FIG. 2, the first thin film transistor M1, the second thin film transistor M2, the third thin film transistor M3, the fourth thin film transistor M4, the fifth thin film transistor M5, the sixth thin film transistor M6, and the seventh thin film transistor M7 are all a P-type thin film transistor, and the light-emitting diode D1 is an OLED.

The circuit connection structure of the pixel circuit shown in FIG. 2 is as follows: a gate of the first thin film transistor M1 is separately connected to a source of the third thin film transistor M3, a source of the fourth thin film transistor M4 and one end of the storage capacitor Cst (the point B shown in FIG. 2), a source of the first thin film transistor M1 is separately connected to a drain of the second thin film transistor M2, a drain of the fifth thin film transistor M5 and a source of the seventh thin film transistor M7; and a drain of the first thin film transistor M1 is separately connected to a drain of the third thin film transistor M3 and a source of the sixth thin film transistor M6; a source of the second thin film transistor M2 is connected to a data voltage signal line; a drain of the fourth thin film transistor M4 is connected to a reference voltage signal line; a source of the fifth thin film transistor M5 is connected to a first power supply VDD; drain of the sixth thin film transistor M6 is connected an anode of the light-emitting diode D1; a drain of the seventh thin film transistor M7 is connected to the other end of the storage capacitor Cst (the point A shown in FIG. 2); a cathode of the light-emitting diode D1 is connected to a second power supply VSS; and an output end of the compensation module is separately connected to the drain of the seventh thin film transistor M7 and the other end of the storage capacitor Cst (the point A shown in FIG. 2).

It should be noted that, in practical applications, the third thin film transistor M3 shown in FIG. 2 may be replaced with two common-gate thin film transistors, so that during the operation of the pixel circuit, the two common-gate thin film transistors can reduce the leakage current of the branch at which the third thin film transistor M3 is located. Similarly, the fourth thin film transistor M4 can also be replaced with the two common-gate thin film transistors to reduce the leakage current of the branch at which the fourth thin film transistor M4 is located. In addition, as for other thin film transistors in FIG. 2 which can be regarded as a switching transistor, one or more thin film transistors can be replaced with the two common-gate thin film transistors according to actual requirements, so as to reduce the leakage current of the branch at which the current is located, which is not specifically limited in the embodiment of the application.

In the embodiment of the application, the first power supply VDD may be a positive voltage and is used to provide a supply voltage for the first thin film transistor M1. The first thin film transistor M1 may output a current under the action of the first power supply VDD. The current flows into the light-emitting diode D1 to make the light-emitting diode D1 emit light. When the light-emitting diode D1 emits the light, the current flows into the second power supply VSS. The second power supply VSS may be a negative voltage.

The data voltage signal line can be used to provide a data voltage Vdata. The reference voltage signal line can be used to provide a reference voltage VREF. In the embodiment of the application, the reference voltage VREF may be a negative voltage and be used to initialize the gate of the first thin film transistor M1.

In the embodiment of the application, the compensation module can provide a compensation voltage, and the compensation module may control the compensation voltage to apply a voltage to the gate of the first thin film transistor M1 through the storage capacitor Cst, such that the compensation voltage may compensate for the power supply voltage supplied by the first power supply VDD during operation of the pixel circuit, thereby making the current flowing through the light-emitting diode D1 independent of the first power supply VDD.

It should be noted that, in the embodiment of the application, the compensation voltage may be the positive voltage or negative voltage. Wherein, when the compensation voltage is the positive voltage, the compensation voltage may be greater than the first power supply VDD; when the compensation voltage is the negative voltage, the compensation voltage and the reference voltage VREF may be supplied by the same power supply. At this time, the data voltage Vdata may be the negative voltage and smaller than the compensation voltage.

In the pixel circuit shown in FIG. 2, S1 is a first scan signal provided by a first scan line, S2 is a second scan signal provided by a second scan line, and EM is a light-emitting control signal provided by a light-emitting control line, wherein: a gate of the fourth thin film transistor M4 is connected to the first scan line, and the first scan signal S1 provided by the first scan line can control the fourth thin film transistor M4 to make the fourth thin film transistor M4 in an on-state or an off-state; a gate of the second thin film transistor M2 and a gate of the third thin film transistor M3 are connected to the second scan line; the second scan signal S2 provided by the second scan line can control the second thin film transistor M2 and the third thin film transistor M3 to make the second thin film transistor M2 and the third thin film transistor M3 in the on-state or off-state; a gate of the fifth thin film transistor M5, a gate of the sixth thin film transistor M6 and a gate of the seventh thin film transistor M7 are connected to the light-emitting control line, and the light-emitting control signal EM provided by the light-emitting control line can control the fifth film transistor M5, the sixth thin film transistor M6, and the seventh thin film transistor M7 to make the fifth film transistor M5, the sixth thin film transistor M6, and the seventh thin film transistor M7 in the on-state or off-state.

In the embodiment of the application, when the first scan signal S1 controls the fourth thin film transistor M4 to make the fourth thin film transistor M4 in the on-state, the reference voltage VREF may apply a voltage to the gate of the first thin film transistor M1 via the fourth thin film transistor M4 and initialize the gate of the first thin film transistor M1; when the second scan signal S2 controls the second thin film transistor M2 and the third thin film transistor M3 to make the second thin film transistor M2 and the third thin film transistor M3 in the on-state, as for the first thin film transistor M1, the gate and the drain of the first thin film transistor M1 are connected to each other, and the data voltage Vdata applies a voltage to the source of the first thin film transistor M1 via the second thin film transistor M2. After the state of the circuit is stabilized, a source voltage of the first thin film transistor M1 is Vdata, and a gate voltage and a drain voltage are both Vdata-Vth, thereby achieving the compensation for a threshold voltage of the first thin film transistor M1, wherein Vth is the threshold voltage of the first thin film transistor M1; when the light-emitting control signal EM controls the fifth thin film transistor M5, the sixth thin film transistor M6 and the seventh thin film transistor M7 to make the fifth thin film transistor M5, the sixth thin film transistor M6 and the seventh thin film transistor M7 in the on-state, the first power supply VDD may apply a voltage to the source of the first thin film transistor M1 via the fifth thin film transistor M5. The first thin film transistor M1 can generate a current which flows through the light-emitting diode D1 to make the light-emitting diode D1 emit light.

In addition, when the light-emitting control signal EM controls the fifth thin film transistor M5 and the seventh thin film transistor M7 to make the fifth thin film transistor M5 and the seventh thin film transistor M7 in the on-state, the first power supply VDD may also be connected to the other end of the storage capacitor Cst (the point A shown in FIG. 2). At this time, the compensation module may control the compensation voltage to cut off from the storage capacitor Cst, such that the voltage of the upper plate (the point A shown in FIG. 2) of the storage capacitor Cst is changed from the compensation voltage to VDD. Therefore, the action of the storage capacitor Cst can cause the current flowing through the light-emitting diode D1 to be related to the compensation voltage VIN and independent of the first power supply VDD, thereby achieving the compensation for the first power supply VDD, and can cause the power supply voltage drop generated by the first power supply VDD not to influence on the current flowing through the light-emitting diode D1, thereby ensuring the display evenness of the display device.

In another embodiment provided by the application, the compensation module may include a compensation voltage signal line and the eighth thin film transistor, wherein the compensation voltage signal line may be used to provide a compensation voltage, and the eighth thin film transistor may be the P-type thin film transistor and may also be the N-type thin film transistor.

Figure 3:
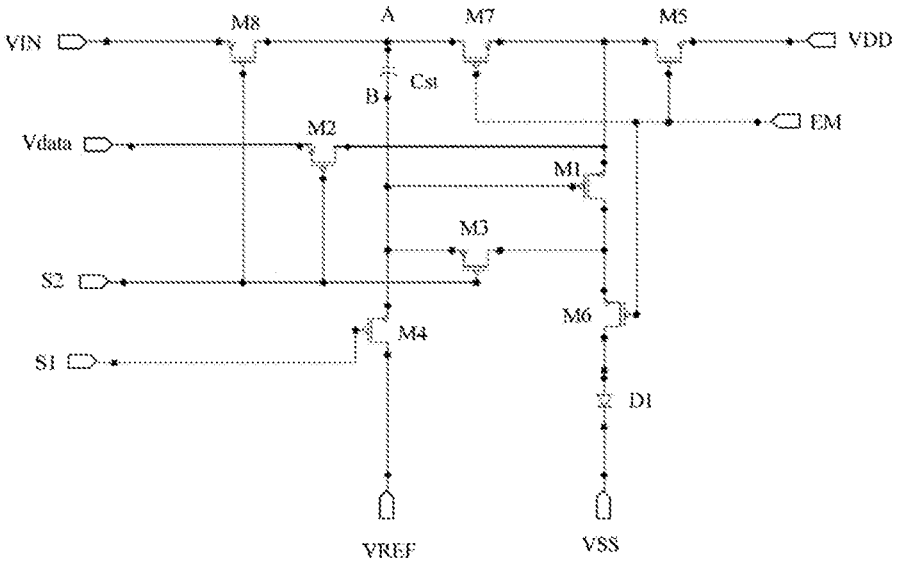
FIG. 3 is a schematic structural diagram of another pixel circuit provided by an embodiment of the application.

FIG. 3 is a schematic structural diagram of another pixel circuit provided by an embodiment of the application. Wherein in comparison with FIG. 2, in FIG. 3, the compensation module shown in FIG. 2 is replaced with the compensation voltage signal line and the eighth thin film transistor M8.

In FIG. 3, VIN is the compensation voltage provided by the compensation voltage signal line, and the eighth thin film transistor M8 is the P-type thin film transistor, wherein a source of the eighth thin film transistor M8 is connected to the compensation voltage signal line, a drain thereof is separately connected to the drain of the seventh thin film transistor M7 and the other end of the storage capacitor Cst (the point A shown in FIG. 3), and a gate thereof is connected to the second scan line.

In the pixel circuit shown in FIG. 3, the second scan line S2 can control the eighth thin film transistor M8 to make the eighth thin film transistor M8 in the on-state or off-state. When the second scan line S2 controls the eighth thin film transistor M8 to make the eighth thin film transistor M8 in the on-state, a voltage can be applied to the upper plate of the storage capacitor Cst (the point A shown in FIG. 3) by the compensation voltage VIN, such that the voltage of the upper plate of the storage capacitor Cst is VIN.

Thus, when the light-emitting control signal EM controls the fifth thin film transistor M5 and the seventh thin film transistor M7 to make the fifth thin film transistor M5 and the seventh thin film transistor M7 in the on-state, the first power supply VDD is connected to the other end of the storage capacitor Cst (the point A shown in FIG. 3) and the first power supply VDD applies a voltage to the upper plate of the storage capacitor Cst, so that the voltage of the upper plate of the storage capacitor Cst is changed from VIN to VDD. Therefore, the current flowing through the light-emitting D1 is related to the compensation voltage VIN and independent of the first power supply VDD under the action of the storage capacitor Cst, thereby achieving the compensation for the first power supply VDD, such that the power supply voltage drop generated by the first power supply VDD does not influence on the current flowing through the light-emitting D1, ensuring display evenness of the display device.

Figure 4:
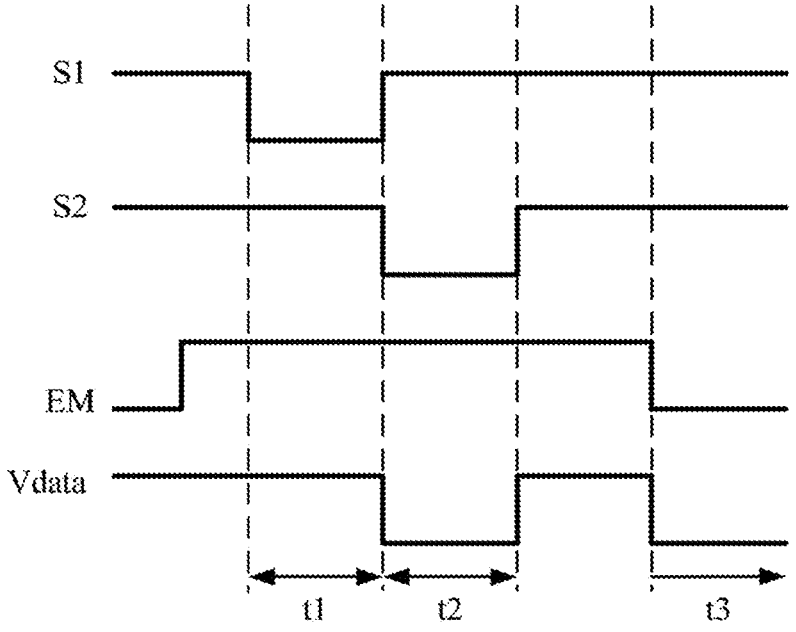
FIG. 4 is a timing diagram of a method for driving a pixel circuit provided by an embodiment of the application.

FIG. 4 is a timing diagram of a driving method for a pixel circuit provided by an embodiment of the application. The driving method of the pixel circuit may be used to drive the pixel circuit shown in FIG. 2 or FIG. 3. The following will be described by taking the pixel circuit shown in FIG. 3 for example.

When the timing diagram shown in FIG. 4 drives the pixel circuit shown in FIG. 3, the duty cycle may include three stages: a first stage t1, a second stage t2, and a third stage t3. The following explains the above three stages separately:

With respect to the first stage t1: since a first scan signal S1 changes from a high level to a low level, a second scan signal S2 maintains the high level and a light-emitting control signal EM changes from the low level to the high level, the fourth thin film transistor M4 is in an on-state, the second thin film transistor M2, the third thin film transistor M3 and the eighth thin film transistor M8 are in an off-state, and the fifth thin film transistor M5, the sixth thin film transistor M6 and the seventh thin film transistor M7 are in the off-state.

At this time, the reference voltage VREF applies a voltage to the gate of the first thin film transistor M1 and the lower plate of the storage capacitor Cst (the point B shown in FIG. 3) via the fourth thin film transistor M4 and initializes the gate of the first thin film transistor M1 and the lower plate of the storage capacitor Cst.

After initialization, the gate voltage of the first thin film transistor M1 is equal to VREF, and the voltage of the lower plate of the storage capacitor Cst is also VREF.

With respect to the second stage t2: since the first scan signal S1 changes from the low level to the high level, the second scan signal S2 changes from the high level to the low level and the light-emitting control signal EM remains at the high level, the fourth thin film transistor M4 changes from the on-state to the off-state, and the second thin film transistor M2, the third thin film transistor M3 and the eighth thin film transistor M8 change from the off-state to the on-state, the fifth thin film transistor M5, the sixth thin film transistor M6 and the seventh thin film transistor M7 are still in the off-state.

At this time, the gate of the first thin film transistor M1 is connected to the drain thereof, and the data voltage Vdata applies a voltage to the source of the first thin film transistor M1 via the second thin film transistor M2. At this time, the voltage of the source of the first thin film transistor M1 is Vdata. Since the voltage of the gate of the first thin film transistor M1 is VREF in the first stage t1, the first thin film transistor M1 is in the on-state. The data voltage Vdata acts on the gate of the first thin film transistor M1 via the first thin film transistor M1 and the third thin film transistor M3, which finally causes both the voltage of the gate and the voltage of the drain of the first thin film transistor M1 to be Vdata-Vth, making the first thin film transistor M1 in the off-state, thereby achieving the compensation for the threshold voltage of the first thin film transistor M1, wherein Vth is the threshold voltage of the first thin film transistor M1.

In addition, the compensation voltage VIN applies a voltage to the upper plate of the storage capacitor Cst via the eighth thin film transistor M8 so that the voltage of the upper plate of the storage capacitor Cst becomes VIN. At this time, since the voltage of the lower plate of the storage capacitor Cst is equal to the voltage of the gate of the first thin film transistor M1, the voltage of the lower plate of the storage capacitor Cst is Vdata-Vth, and the voltage difference between the lower plate and the upper plate of the storage capacitor Cst is Vdata-Vth-VIN.

With respect to the third stage t3: since the first scan signal S1 remains at the high level, the second scan signal S2 changes from the low level to the high level and the light-emitting control signal EM changes from the high level to the low level, the fourth thin film transistor M4 is still in the off-state, and the second thin film transistor M2, the third thin film transistor M3 and the eighth thin film transistor M8 change from the on-state to the off-state, and the fifth thin film transistor M5, the sixth thin film transistor M6 and the seventh thin film transistor M7 change from the off-state to the on-state.

At this time, the first power supply VDD applies a voltage to the upper plate of the storage capacitor Cst via the fifth thin film transistor M5 and the seventh thin film transistor M7, so that the voltage of the upper plate of the storage capacitor Cst becomes VDD. Due to the coupling effect of the storage capacitor Cst at this time, the voltage difference between the lower plate and the upper plate of the storage capacitor Cst does not change, and the voltage of the lower plate of the storage capacitor Cst is VDD+Vdata-Vth-VIN. Since the voltage of the gate of the thin film transistor M1 is equal to the voltage of the lower plate of the storage capacitor Cst, the voltage of the gate of the first thin film transistor M1 is VDD+Vdata-Vth-VIN.

The first power supply VDD applies a voltage to the source of the first thin film transistor M1 via the fifth thin film transistor M5 so that the voltage of the source of the first thin film transistor M1 is VDD, the first thin film transistor M1 is turned on, the current flows through the light-emitting diode D1, and the light-emitting diode D1 emits light.

In the third stage t3, the current flowing through the light-emitting diode D1 can be expressed as:

$$I_{OLED} = \mu C_{ox}\frac{W}{2L}(V_{gs} - Vth)^2 = \mu C_{ox}\frac{W}{2L}(V_s - V_g - Vth)^2 = \mu C_{ox}\frac{W}{2L}(VIN - Vdata)^2$$

Wherein, μ is the electron mobility of the first thin film transistor M1, $C_{ox}$ is the gate oxide layer capacitance per unit area of the first thin film transistor M1 and W/L is the aspect ratio of the first thin film transistor M1.

It can be known from the above equation that the current flowing through the light-emitting diode D1 is related to the compensation voltage VIN, and is independent of the first power supply VDD and is also independent of the threshold voltage of the first thin film transistor M1, thereby realizing the compensation for the first power supply VDD, and avoiding the influence of the power supply voltage drop of the first power supply VDD on the display effect and ensuring the display evenness of the display device, and at the same time, realizing the compensation for the threshold voltage of the first thin film transistor M1 and avoiding the problem of the uneven display of the display device due to different threshold voltages of the first thin film transistors M1.

It should be noted that in practical applications, the compensation voltage VIN also has a certain voltage drop. However, since the compensation voltage VIN only needs to charge the storage capacitor Cst and does not participate in driving the pixel circuit, the current generated by the compensation voltage VIN is much smaller than the current generated by the first power supply VDD, and the voltage drop generated is also much smaller than the voltage drop generated by the first power supply VDD. That is, in the embodiment of the application, the current flowing through the light-emitting diode D1 is determined by the compensation voltage VIN, effectively improving the display unevenness of the display device caused by the supply voltage.

In practical applications, a simulation is performed by using the pixel circuit provided by the embodiments of the application with the compensate voltage VIN=4.6V, the data voltage Vdata=2V and the first power supply VDD=4.3/4.4/4.5/4.6/4.7/4.8V, which can obtains a simulation result: when the first power supply VDD changes, the ratio of the minimum value to the maximum value of the current flowing through the light-emitting diode D1 is about 92%, and the simulation is performed by using the pixel circuit shown in FIG. 1 with the same voltage parameter to obtain about 67% of the ratio of the minimum value to the maximum value of the current flowing through the light-emitting diode D1. As can be seen, when the first power supply VDD changes, the change in the current flowing through the light-emitting diode D1 in the pixel circuit provided by the embodiments of the application is smaller than the change in the current flowing through the light-emitting diode D1 in FIG. 1. Therefore, the pixel circuit provided the embodiment of the application effectively improves the display evenness of the display device.

In addition, the simulation is performed by using the pixel circuit provided by the embodiments of the application with the compensation voltage VIN=4.6V, the data voltage Vdata=2V and the first power supply VDD=4.6V, which can obtains that the current generated when the storage capacitor Cst is charged by the compensation voltage VIN is about 2 pA, which is much smaller than the current 306 nA generated when the first power supply VDD acts on the first thin film transistor M1. Thus, since the current generated by the compensation voltage VIN is smaller than the current generated by the first power supply VDD, the voltage drop generated when the compensation voltage VIN is transmitted from one pixel circuit to another pixel circuit is also smaller than the power supply voltage drop generated by the first power supply VDD. As can be seen, compared with the first power supply VDD, the compensation voltage VIN determines the current flowing through the light-emitting diode D1, which can effectively improve the display evenness of the display device.

In addition, the pixel circuit provided by the embodiments of the application can also achieve compensation for the threshold voltage of a drive thin film transistor, thereby effectively avoiding the problem of the uneven display of the display device due to different threshold voltages of drive thin film transistors.

The embodiments of the application further provide a display device, and the display device may include the pixel circuits described above.

It is apparent that a person skilled in the art can make various modifications and variations to the application without departing from the scope of the application. Thus, if such modifications and variations of the application are within the scope of the claims of the application and the technical equivalents thereof, the application is also intended to include such modifications and variations.

What is claimed is:

1. A pixel circuit, comprising:

a first thin film transistor, a second thin film transistor, a third thin film transistor, a fourth thin film transistor, a fifth thin film transistor, a sixth thin film transistor, a seventh thin film transistor, a light-emitting diode, a storage capacitor and a compensation module, wherein a gate of the first thin film transistor is separately connected to a source of the third thin film transistor, a source of the fourth thin film transistor and one end of the storage capacitor, a drain of the fourth thin film transistor is connected to a reference voltage signal line, and the other end of the storage capacitor is separately connected to a drain of the seventh thin film transistor and an output terminal of the compensation module;

a source of the first thin film transistor is separately connected to a drain of the second thin film transistor, a drain of the fifth thin film transistor and a source of the seventh thin film transistor, and a source of the second thin film transistor is connected to the data voltage signal line, and a source of the fifth thin film transistor is connected to the first power supply; and a drain of the first thin film transistor is separately connected to a drain of the third thin film transistor and a source of the sixth thin film transistor, and a drain of the sixth thin film transistor is connected to an anode of the light-emitting diode, and a cathode of the light-emitting diode is connected to a second power supply, wherein the compensation module provides a compensation voltage, and the compensation module controls the compensation voltage to apply the compensation voltage to the gate of the first thin film transistor via the storage capacitor, and compensates for the power supply voltage provided by the first power supply, to make the voltage flow through the light-emitting diode independent of the first power supply, wherein the compensation voltage is a positive voltage and the compensation voltage is greater than the power supply voltage provided by the first power supply, wherein the first power supply provides a power supply voltage for the first thin film transistor, and a current flows into the second power supply when the light-emitting diode emits light, wherein the data voltage signal line provides a data voltage, the reference voltage signal line provides a reference voltage, and the reference voltage is a negative voltage and initializes the gate of the first thin film transistor, wherein the gate of the fourth thin film transistor is connected to a first scan line, and when a first scan signal provided by the first scan line controls the fourth thin film transistor to make the fourth thin film transistor in an on-state, the reference voltage initializes the gate of the first thin film transistor, wherein a gate of the second thin film transistor and a gate of the third thin film transistor are connected to a second scan line, and when a second scan signal provided by the second scan line controls the second thin film transistor and the third thin film transistor to make the second thin film transistor and the third thin film transistor in the on-state, the compensation voltage compensates for a threshold voltage of the first thin film transistor, wherein a gate of the fifth thin film transistor, a gate of the sixth thin film transistor, and a gate of the seventh thin film transistor are connected to a light-emitting control line, and a light-emitting control signal provided by the light-emitting control line controls the fifth thin film transistor, the sixth thin film transistor, and the seventh thin film transistor to make the fifth thin film transistor, the sixth thin film transistor, and the seventh thin film transistor in the on-state, and the current flows through the light-emitting diode.

2. The pixel circuit according to claim 1, wherein the compensation voltage is a negative voltage, and the compensation voltage and a reference voltage provided by the reference signal line are provided by the same power supply.

3. The pixel circuit according to claim 1, wherein when the compensation voltage is a negative voltage, the data voltage provided by the data voltage signal line is negative voltage and the data voltage is smaller than the compensation voltage.

4. The pixel circuit according to claim 1, wherein the compensation module comprises a compensation voltage signal line and an eighth thin film transistor, the compensation voltage signal line provides the compensation voltage;

a source of the eighth thin film transistor is connected to the compensation voltage signal line, a drain of the eighth thin film transistor is separately connected to the drain of the seventh thin film transistor and the other end of the storage capacitor, and a gate of the eighth thin film transistor is connected to the second scan line.

5. The pixel circuit according to claim 4, wherein when the second scan signal controls the eighth thin film transistor to make the eighth thin film transistor in the on-state, the compensation voltage signal line is connected to the other end of the first capacitance, and the compensation voltage signal line applies a voltage to the storage capacitor;

when the light-emitting control signal controls the fifth thin film transistor and the seventh thin film transistor to make the fifth thin film transistor and the seventh thin film transistor in the on-state, the first power supply is connected to the other end of the storage capacitor, the first power supply applies a voltage to the other end of the storage capacitor, and under the action of the storage capacitor, the current flowing through the light-emitting diode is related to the compensation voltage and independent of the first power supply.

6. The pixel circuit according to claim 5, wherein the first thin film transistor is a drive thin film transistor and the first thin film transistor is a P-type thin film transistor;

the second thin film transistor, the third thin film transistor, the fourth thin film transistor, the fifth thin film transistor, the sixth thin film transistor, the seventh thin film transistor and the eighth thin film transistor are independently N-type thin film transistors or P-type thin film transistors.

7. The pixel circuit according to claim 6, wherein at least one of the second thin film transistor, the third thin film transistor, the fourth thin film transistor, the fifth thin film transistor, the sixth thin film transistor, the seventh thin film transistor and the eighth thin film transistor can be replaced by two common-gate thin film transistor.

8. A driving method of a pixel circuit according to claim 1, comprising:

in a first stage, controlling the fourth thin film transistor to change the fourth thin film transistor from an off-state to an on-state by the first scan signal, and initializing the gate of the first thin film transistor and one end of the storage capacitor by the reference voltage, controlling the second thin film transistor and the third thin film transistor to make the second thin film transistor and the third thin film transistor in the off-state by the second scan signal, and controlling the fifth thin film transistor, the sixth thin film transistor and the seventh thin film transistor to make the fifth thin film transistor, the sixth thin film transistor and the seventh thin film transistor in the off-state by the light-emitting control signal;

in a second stage, controlling the fourth thin film transistor to change the fourth thin film transistor from the on-state to the off-state by the first scan signal, controlling the second thin film transistor and the third thin film transistor to change the second thin film transistor and the third thin film transistor from the off-state to an on-state by the second scan signal, and compensating for the threshold voltage of the first thin film transistor, controlling the fifth thin film transistor, the sixth thin film transistor and the seventh thin film transistor to make the fifth thin film transistor, the sixth thin film transistor and the seventh thin film transistor in the off-state by the light-emitting control signals, and applying the compensation voltage to the other end of the storage capacitor by the compensation module; and in a third stage, controlling the fourth thin film transistor to make the fourth thin film transistor in the off-state by the first scan signal, and controlling the second thin film transistor and the third thin film transistor to change the second thin film transistor and the third thin film transistor from the on-state to the off-state by the second scan signal, controlling the fifth thin film transistor, the sixth thin film transistor, and the seventh thin film transistor to change the fifth thin film transistor, the sixth thin film transistor, and the seventh thin film transistor from the off-state to the on-state by the light-emitting control signal, and emitting light by the light-emitting diode.

9. The driving method according to claim 8, wherein in the third stage, the compensation voltage compensates for the first power supply, and the current flowing through the light-emitting diode is independent from the first power supply.

10. A display device, wherein the display device comprises the pixel circuit according to claim 1, the pixel circuit having a first thin film transistor, a second thin film transistor, a third thin film transistor, a fourth thin film transistor, a fifth thin film transistor, a sixth thin film transistor, a seventh thin film transistor, a light-emitting diode, a storage capacitor and a compensation module, a gate of the first thin film transistor is separately connected to a source of the third thin film transistor, a source of the fourth thin film transistor and an one end of the storage capacitor, a drain of the fourth thin film transistor is connected to a reference voltage signal line, and the other end of the storage capacitor is separately connected to a drain of the seventh thin film transistor and an output terminal of the compensation module;

a source of the first thin film transistor is separately connected to a drain of the second thin film transistor, a drain of the fifth thin film transistor and a source of the seventh thin film transistor, and a source of the second thin film transistor is connected to the data voltage signal line, and a source of the fifth thin film transistor is connected to the first power supply;

a drain of the first thin film transistor is separately connected to a drain of the third thin film transistor and a source of the sixth thin film transistor, and a drain of the sixth thin film transistor is connected to an anode of the light-emitting diode, and a cathode of the light-emitting diode is connected to a second power supply, wherein the compensation module provides a compensation voltage, and the compensation module controls the compensation voltage to apply the compensation voltage to the gate of the first thin film transistor via the storage capacitor, and compensates for the power supply voltage provided by the first power supply, to make the voltage flow through the light-emitting diode independent of the first power supply, wherein the compensation voltage is a positive voltage and the compensation voltage is greater than the power supply voltage provided by the first power supply, wherein the first power supply provides a power supply voltage for the first thin film transistor, and a current flows into the second power supply when the light-emitting diode emits light, wherein the data voltage signal line provides a data voltage, the reference voltage signal line provides a reference voltage, and the reference voltage is a negative voltage and initializes the gate of the first thin film transistor, wherein the gate of the fourth thin film transistor is connected to a first scan line, and when a first scan signal provided by the first scan line controls the fourth thin film transistor to make the fourth thin film transistor in an on-state, the reference voltage initializes the gate of the first thin film transistor, wherein a gate of the second thin film transistor and a gate of the third thin film transistor are connected to a second scan line, and when a second scan signal provided by the second scan line controls the second thin film transistor and the third thin film transistor to make the second thin film transistor and the third thin film transistor in the on-state, the compensation voltage compensates for a threshold voltage of the first thin film transistor, wherein a gate of the fifth thin film transistor, a gate of the sixth thin film transistor, and a gate of the seventh thin film transistor are connected to a light-emitting control line, and a light-emitting control signal provided by the light-emitting control line controls the fifth thin film transistor, the sixth thin film transistor, and the seventh thin film transistor to make the fifth thin film transistor, the sixth thin film transistor, and the seventh thin film transistor in the on-state, and the current flows through the light-emitting diode.

* * * * *